US009577347B2

(12) United States Patent
Chakam et al.

(10) Patent No.: US 9,577,347 B2
(45) Date of Patent: Feb. 21, 2017

(54) ANTENNA STRUCTURE OF A CIRCULAR-POLARIZED ANTENNA FOR A VEHICLE

(71) Applicant: CONTINENTAL AUTOMOTIVE GMBH, Hannover (DE)

(72) Inventors: Guy-Aymar Chakam, Saal an der Donau (DE); Benjamin Becker, Regensburg (DE); Manuel Mielke, Pressath (DE)

(73) Assignee: Continental Automotive GmbH, Hannover (DE)

( * ) Notice: Subject to any disclaimer, the term of this patent is extended or adjusted under 35 U.S.C. 154(b) by 69 days.

(21) Appl. No.: 14/430,615

(22) PCT Filed: Sep. 19, 2013

(86) PCT No.: PCT/EP2013/069428

§ 371 (c)(1),
(2) Date: Mar. 24, 2015

(87) PCT Pub. No.: WO2014/044734

PCT Pub. Date: Mar. 27, 2014

(65) Prior Publication Data

US 2015/0263436 A1 Sep. 17, 2015

(30) Foreign Application Priority Data

Sep. 24, 2012 (DE) ..... 10 2012 217 113

(51) Int. Cl.
*H01Q 1/52* (2006.01)
*H01Q 21/26* (2006.01)
(Continued)

(52) U.S. Cl.
CPC ..... *H01Q 21/26* (2013.01); *H01Q 1/3275* (2013.01); *H01Q 1/526* (2013.01); *H01Q 9/26* (2013.01); *H01Q 9/30* (2013.01)

(58) Field of Classification Search
CPC ..... H01Q 1/52; H01Q 1/526; H01Q 9/26; H01Q 9/30; H01Q 21/26; H01Q 1/3275
See application file for complete search history.

(56) References Cited

U.S. PATENT DOCUMENTS 3,680,135 A 7/1972 Boyer
5,592,182 A 1/1997 Yao et al.
(Continued)

FOREIGN PATENT DOCUMENTS

DE 1905330 A1 9/1969
DE 10163793 A1 9/2002
(Continued)

OTHER PUBLICATIONS

Krischke, Alois: "Rothmmels Antennenbuch—Kreuzdipol (Turnstile)", updated 12. Edition 2001, 4th print, Baunatal: DARC-Verlag, 2006, pp. 526-527—ISBN:3-88692-003-X—English translation.

*Primary Examiner* — Hoang V Nguyen
(74) *Attorney, Agent, or Firm* — Laurence Greenberg; Werner Stemer; Ralph Locher

(57) ABSTRACT

A turnstile antenna has two dipoles which have a galvanic contact at the crossing point. The dipoles are arranged in a geometrically asymmetrical manner with respect to the crossing point. The turnstile antenna can be arranged either in a free space or over a metal plate.

11 Claims, 4 Drawing Sheets

(51) Int. Cl.

| | |
|---|---|
| ***H01Q 1/32*** | (2006.01) |
| ***H01Q 9/26*** | (2006.01) |
| ***H01Q 9/30*** | (2006.01) |

(56) References Cited

U.S. PATENT DOCUMENTS

| | | | | |
|---|---|---|---|---|
| 6,014,107 | A * | 1/2000 | Wiesenfarth | H01Q 9/0421 343/742 |
| 6,486,848 | B1 | 11/2002 | Poilasne et al. | |
| 6,542,128 | B1 | 4/2003 | Johnson et al. | |
| 6,653,982 | B2 | 11/2003 | Lindenmeier et al. | |
| 6,911,946 | B2 | 6/2005 | Lindenmeier | |
| 7,123,203 | B2 | 10/2006 | Le Geoff et al. | |
| 7,432,862 | B2 | 10/2008 | Heyde | |
| 7,450,081 | B1 | 11/2008 | Punnoose | |
| 8,098,205 | B2 * | 1/2012 | Rabinovich | H01Q 1/3275 343/700 MS |
| 8,638,270 | B2 | 1/2014 | Payne | |
| 8,965,213 | B2 | 2/2015 | Zhao et al. | |
| 2009/0027294 | A1 | 1/2009 | Bourry et al. | |
| 2013/0027258 | A1 | 1/2013 | Chakam | |

FOREIGN PATENT DOCUMENTS

| | | | |
|---|---|---|---|
| DE | 10209060 | A1 | 9/2003 |
| DE | 102010004470 | A1 | 7/2011 |
| EP | 1341260 | A1 | 9/2003 |
| EP | 2343777 | A1 | 7/2011 |
| FR | 2841388 | A1 | 12/2003 |
| JP | 2003338783 | A | 11/2003 |
| WO | 9703479 | A1 | 1/1997 |
| WO | 0176007 | A1 | 10/2001 |
| WO | 2006000116 | A1 | 1/2006 |
| WO | 2009013347 | A1 | 1/2009 |
| WO | 2010129628 | A1 | 11/2010 |
| WO | 2011017198 | A2 | 2/2011 |

* cited by examiner

ANTENNA STRUCTURE OF A CIRCULAR-POLARIZED ANTENNA FOR A VEHICLE

BACKGROUND OF THE INVENTION

Field of the Invention

An antenna structure of a circular-polarized antenna for a vehicle is described.

The document WO 01/76007 A1 discloses an antenna structure of a circular-polarized antenna for a vehicle or for a portable communication or navigation appliance. The known antenna structure is envisaged for the use of particular frequencies and has a conductive baseplate and a first and a second conductive element that cross one another. The crossing elements are spaced apart from one another at a crossing point, so that any electrical contact is avoided and no substantial capacitive coupling with respect to one another occurs at the crossing point either. Each element half has a length that corresponds approximately to one quarter wavelength for the envisaged frequency, each element having at least one end section that is arranged generally at right angles to the baseplate and has at least one further section that is provided parallel to the planar conductive baseplate.

The elements and the baseplate generally define a volume, wherein each end of each element is electrically coupled to the baseplate and wherein the elements are coupled to one another via a 90° phase shifter. Hence, this antenna structure has two feed points. Furthermore, the crossing point of the two crossing elements is arranged such that a geometric symmetry is obtained for the crossing point of the crossing elements. In order to be able to use a geometrically symmetrical crossed dipole of this kind to receive circular-polarized satellite signals, the envisaged 90° phase shifter is absolutely necessary. The provision and connection of the phase shifter to the two ends of the crossing antenna elements is also costly.

BRIEF SUMMARY OF THE INVENTION

It is an object of the invention to provide an antenna structure of a circular-polarized antenna for a vehicle that can be integrated into existing antenna modules in a space-saving and inexpensive manner.

This object is achieved by means of the subject matter of the independent claims, and advantageous developments of the invention can be found in the dependent claims.

The invention proposes an antenna structure of a circular-polarized antenna that can be arranged on an electrically conductive surface that has a first λ/2 dipole, a second λ/2 dipole and a crossing point for the first and second λ/2 dipoles to form a crossed dipole. The crossing dipoles are electrically conductively connected at the crossing point. In relation to the crossing point, they have a geometric asymmetry in at least one longitudinal direction of the dipoles or in both longitudinal directions such that the lengths of the dipole limbs from the crossing point to the ends are different, with the asymmetry setting a desired phase shift. In this case, the antenna structure has only one feed point, which is positioned at one end of one of the dipoles, this determining the direction of rotation of the circular polarization.

The antenna structure according to the invention therefore provides two asymmetrically crossing dipoles, particularly above an electrically conductive surface. This antenna structure is fed from a single feed point at one dipole end and, by virtue of the asymmetry, a phase shift is achieved within the desired frequency range when the second dipole is excited. Furthermore, these dipoles can be punched from a metal plate, which gives a great deal of latitude in the configuration or inclination of the polar diagram. These dipoles can alternatively be realized on printed circuit boards, such as FR4 material. Preferably, the first λ/2 dipole is bent in a U shape and the second λ/2 dipole is likewise bent in a U shape. In this preferred embodiment of the invention, the antenna structure therefore has a first λ/2 dipole bent in a U shape and a second λ/2 dipole bent in a U shape. The first λ/2 dipole and the second λ/2 dipole form a crossing point for a crossed dipole, wherein the crossing λ/2 dipoles bent in a U shape are electrically conductively connected at the crossing point and are arranged geometrically asymmetrically in relation to the crossing point.

In comparison with the antenna structure known from the document above, such an antenna structure of an asymmetric crossed dipole has the advantage that a phase shifter is not required, since the configuration of the asymmetry can be used to set a circular polarization for the crossed dipole according to the invention. The use of the asymmetry and of the direct electrical contact between the two dipoles means that only a single feed pin is required. Furthermore, the shapes of polar diagrams for this asymmetric crossed dipole can be broadly matched to the requirements of electrically conductive surfaces such as vehicle roofs, this being possible only to a very restricted degree with the patch antennas used as standard for satellite surfaces, for example. The additional elements that are otherwise customary for patch antennas, such as a base or a shielding chamber beneath the patch antenna in order to achieve an inclination for the polar diagram in relation to a curved electrically conductive surface, are therefore not necessary given the asymmetric configuration of the crossed dipole.

The free configuration of the dipoles makes it possible to achieve complete compensation for severely curved roofs or compensation for windowpane inclinations. This configuration of the crossed dipole provides for the individual dipoles not to be arranged centrally above one another perpendicularly but rather to be provided with an offset. This crossed dipole can also be fed just from a single end of one of the λ/2 dipoles, and there is no requirement for a 90° phase-shifting additional connection to the feed ends of the crossing dipoles. The position of this single feed point and also the asymmetric offset and the configuration of the dipoles allow circular polarization to be produced for the reception of satellite services, as shown by the appended figures.

By relocating the feed point for a dipole to another, for example opposite, end of the dipole, it is possible to change from left-circulating to right-circulating polarization, and vice versa. Furthermore, the configuration allows height compensation for the antenna structure in relation to a curved electrically conductive surface such as an automobile roof, the U-shaped configuration of the dipoles facilitating this task.

As already mentioned above, it is also possible for the antenna characteristic or the polar diagram of the antenna to be reconfigured by reconfiguring the individual dipole arms by means of intrinsic antenna geometry changes. In addition, it is possible to dispense with the phase shifter, reducing costs for hardware and assembly. In addition, inexpensive manufacture by means of punched antenna structures is possible.

In this case, a preferred embodiment of the invention can have provision for a punched and bent sheet metal material to be provided to the crossing λ/2 dipoles that are bent in a U shape, the sheet metal material preferably having a copper alloy that may be protected from corrosion by a gold coating, for example.

In this case, the crossing λ/2 dipoles may be arranged on a printed circuit board material. In addition, the electrically conductive surface is preferably formed by a vehicle roof.

In a further embodiment of the invention, the circular-polarized antenna has an SDARS (Satellite Digital Audio Radio System) antenna for satellite communication frequencies $f_{SDARS}$ between 2.320 GHz≤$f_{SDARS}$≤2.345 GHz. These high satellite communication frequencies mean that a relatively small design is also obtained for the crossed dipoles, with a relatively low height in order to space the crossed dipole apart from an antenna circuit board or from a curved electrically conductive surface of a vehicle roof.

Secondly, the SDARS antenna may be arranged on an electrically conductive top of a shielding chamber for the antenna circuit board, wherein the shielding chamber can enclose an antenna matching circuit, a tuner and/or an amplifier.

In addition, such an antenna structure is used for a GPS (Global Positioning System) antenna for satellite navigation frequencies $f_{GPS}$ between 1.574 GHz≤$f_{GPS}$≤1.577 GHz. In this case too, the antenna structure of the GPS antenna may be arranged on an electrically conductive top of a shielding chamber of an antenna circuit board, wherein the shielding chamber encloses an antenna matching circuit, a tuner and/or an amplifier.

In a further embodiment of the invention, the antenna structure is connected to a matching network and a coaxial feed line or to a receiver or transceiver by means of a limb of one of the crossing λ/2 dipoles. In this case, it is possible to dispense completely with the coupling of a second end of a limb of a crossing λ/2 dipole via a phase shifter, which has the effect of saving space and cost.

In addition, in a further embodiment of the invention, the height h and hence the limb length of the four limbs of the λ/2 dipoles bent in a U shape matches the curvature of the electrically conductive surface such as a vehicle roof such that a horizontal crossing plane for the crossing λ/2 dipoles is obtained.

The overall length of each λ/2 dipole is retained despite the different bends and the different limb heights, the effective wavelength for the respective frequency range being provided for λ.

BRIEF DESCRIPTION OF THE SEVERAL VIEWS OF THE DRAWING

The invention will now be explained in more detail with reference to the appended figures.

DESCRIPTION OF THE INVENTION

Figure 1:
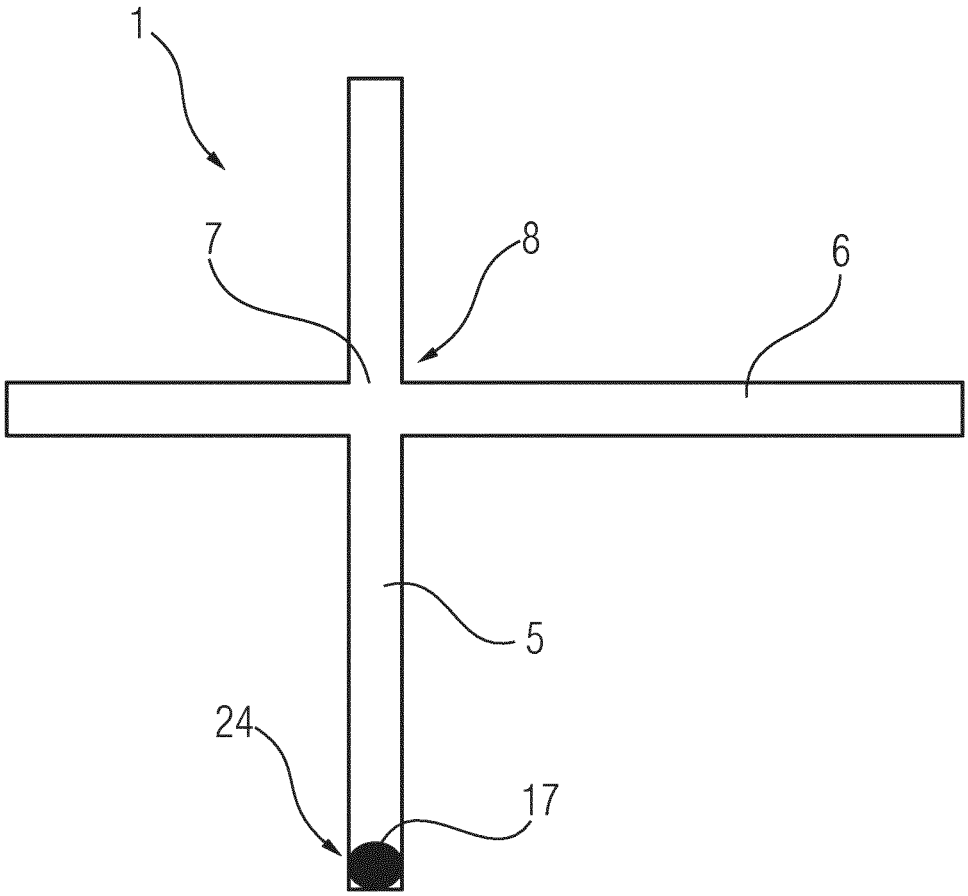
FIG. 1 shows a basic illustration of the antenna structure according to the invention

FIG. 1 shows a basic illustration of the antenna structure 1 according to the invention. The basic illustration of the antenna structure 1 according to the invention comprises two asymmetrically crossing dipoles 5 and 6 that are electrically connected at their crossing point 7 and can be arranged or are arranged above an electrically conductive surface. This antenna structure 1 is fed from a single feed point 17 at one dipole end 24 and, by virtue of the asymmetry, a phase shift is achieved within the desired frequency range when the second dipole 6 is excited. Furthermore, these dipoles 5 and 6 can be punched from a metal plate, which gives a great deal of latitude in the configuration or inclination of the polar diagram. These dipoles 5 and 6 can alternatively be realized on printed circuit boards such as FR4 material.

Figure 2:
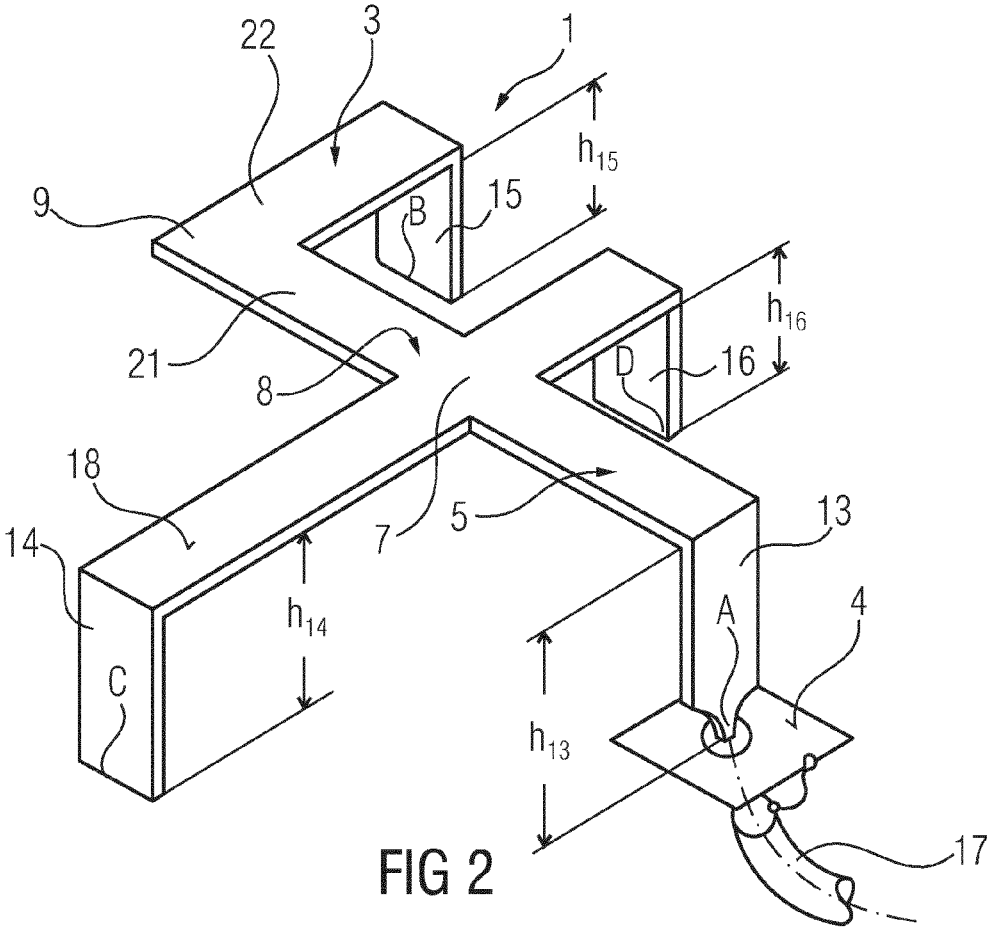
FIG. 2 shows a schematic perspective view of an antenna structure of an asymmetric crossed dipole according to an embodiment of the invention.

FIG. 2 shows a schematic perspective view of an antenna structure 1 of a circular-polarized antenna 3 having an asymmetric crossed dipole 8 according to an embodiment of the invention. In this first embodiment of the invention, the crossed dipole 8 consists of a first λ/2 dipole 5 bent in a U shape and a second λ/2 dipole 6 bent in a U shape. In this arrangement, the length of half of the effective wavelength of the first λ/2 dipole 5 extends from a base point A, which is in the form of a feed point, to a base point B. In addition, the effective λ/2 length of the second λ/2 dipole 6 extends from a base point C to a base point D. The two λ/2 dipoles 5 and 6 are electrically conductively connected at a crossing point 7 at which they encounter one another at right angles.

In this embodiment of the invention, this is achieved by virtue of the entire antenna structure 1 of this crossed dipole 8 being punched from a copper sheet material 9 and bent. This punching and bending can take place in a single production step. In this case, the two λ/2 dipoles 5 and 6 are angled in a U shape. While the base points B, C and D of the limbs 14, 15 and 16 of the λ/2 dipoles 5 and 6 angled in a U shape are fixed on an electrically conductive surface 4 in a capacitive or resistive manner, the base point A of the limb 13 is in the form of a feed point and connected to a coaxial feed line 17.

The limb lengths of the limbs 13 to 16 simultaneously define the heights $h_{13}$, $h_{14}$, $h_{15}$ and $h_{16}$ of an almost horizontal crossing plane 18 above an electrically conductive surface 4, the horizontal crossing plane 18 containing horizontal sections of the two λ/2 dipoles. The horizontal sections for the limbs 13, 14, 15 and 16 are of different length in relation to the crossing point 7, so that an antenna structure 1 of a circular-polarized antenna 3 having an asymmetric crossed dipole 8 is obtained.

The asymmetry prescribes the circular polarization. The latter is determined by the difference in the sum of the length (starting point is the crossing point 8) of the limbs 14 and 18 in comparison with the length of the limbs 24 and 16 and also by the difference in the length of the limbs 21, 22 and 15 in comparison with the sum of the length of the limbs 5 and 13. This structural asymmetry achieves right-circular polarization of the antenna structure 1 if the feed point is maintained at the base point A. If the feed point is moved to the base point B, on the other hand, left-circular polarization is obtained. The different limb lengths of limbs 13 to 16 with the heights $h_{13}$ to $h_{16}$ and also the right-angled angling of the dipole with the limbs 21 and 22 allow—in addition to the phase shift—the shape of the polar diagram to be customarized taking account of the influence of the electrically conductive surfaces or a chassis.

Figure 3:
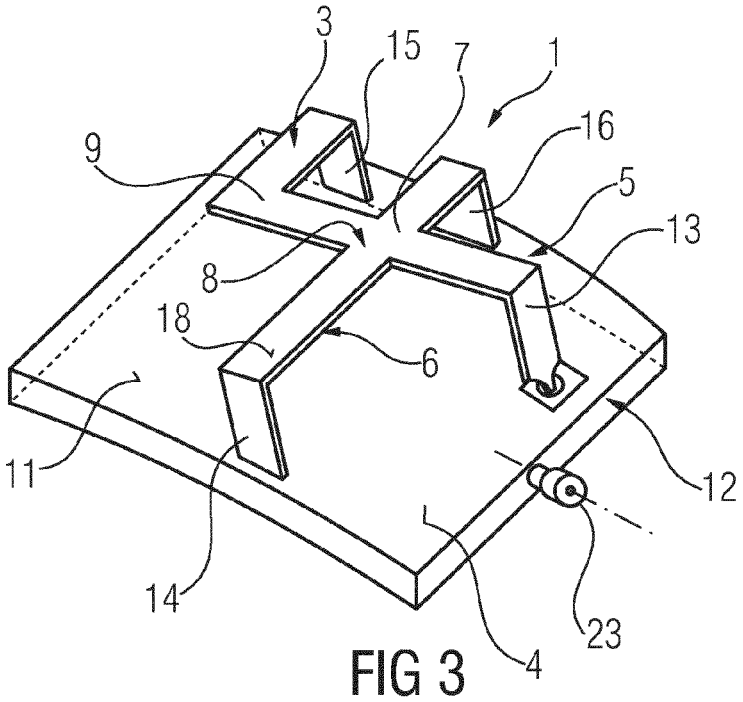
FIG. 3 shows a schematic perspective view of a crossed dipole as shown in FIG. 1 on a shielding chamber.

FIG. 3 shows a schematic perspective view of the asymmetric crossed dipole 8 in FIG. 2 on a shielding chamber 12. Components having the same functions as in FIG. 1 are denoted by the same reference symbols in the subsequent figures and are not discussed separately. This shielding chamber 12 can contain—shielded from the radiating elements of the asymmetric crossed dipole 8—a circuit board having matching circuits, a tuner or an amplifier. From the shielding chamber, an output jack 23 for holding a feed line 17, as shown in FIG. 2, may be provided below an electrically conductive surface 11. By way of example, the electrically conductive top 11 can match the curvature of a vehicle roof. Furthermore, the shielding chamber 12, which has a rectangular top 11 in this case, may also have a round or oval top 11.

Figure 4:
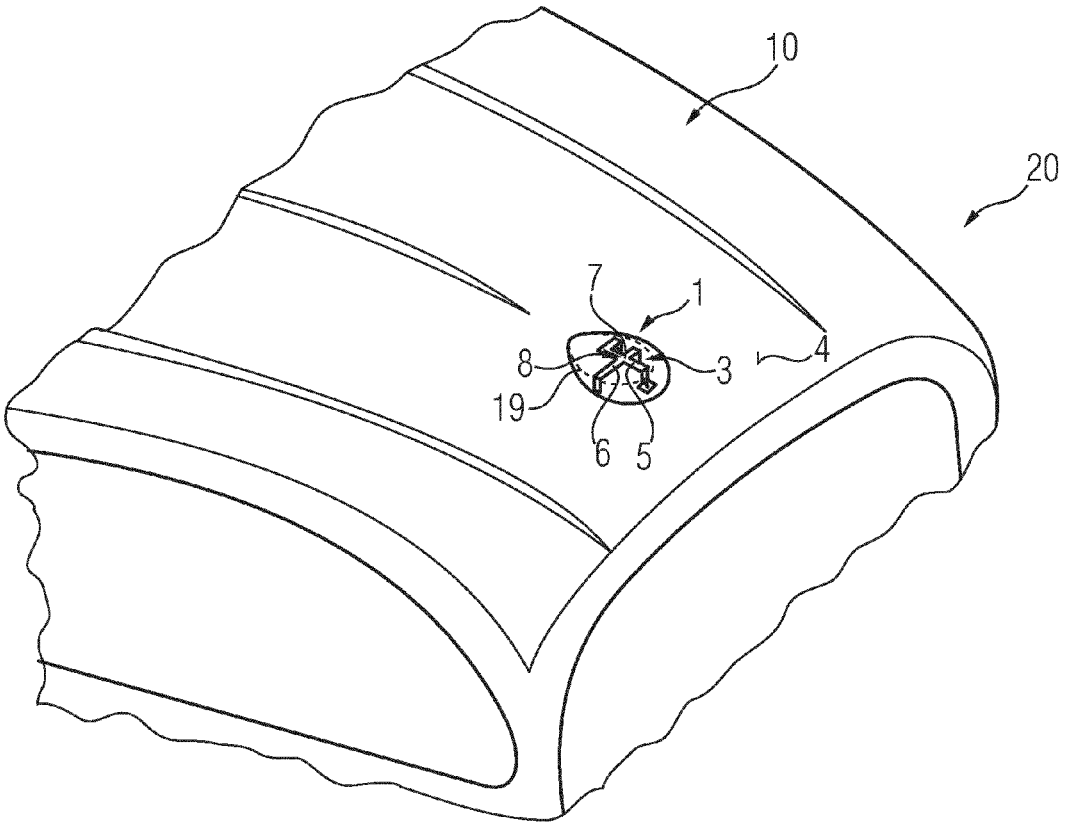
FIG. 4 shows a schematic perspective view of the asymmetric crossed dipole shown in FIG. 1 on a curved vehicle roof.

FIG. 4 shows a schematic perspective view of the asymmetric crossed dipole 8 shown in FIG. 1 on a curved vehicle roof 10, the circular-polarized antenna 3 being arranged under a flat plastic cover 19 and the vehicle roof 10 of the vehicle 20 being used as an electrically conductive surface for the radiating λ/2 dipoles 5 and 6.

Figure 5:
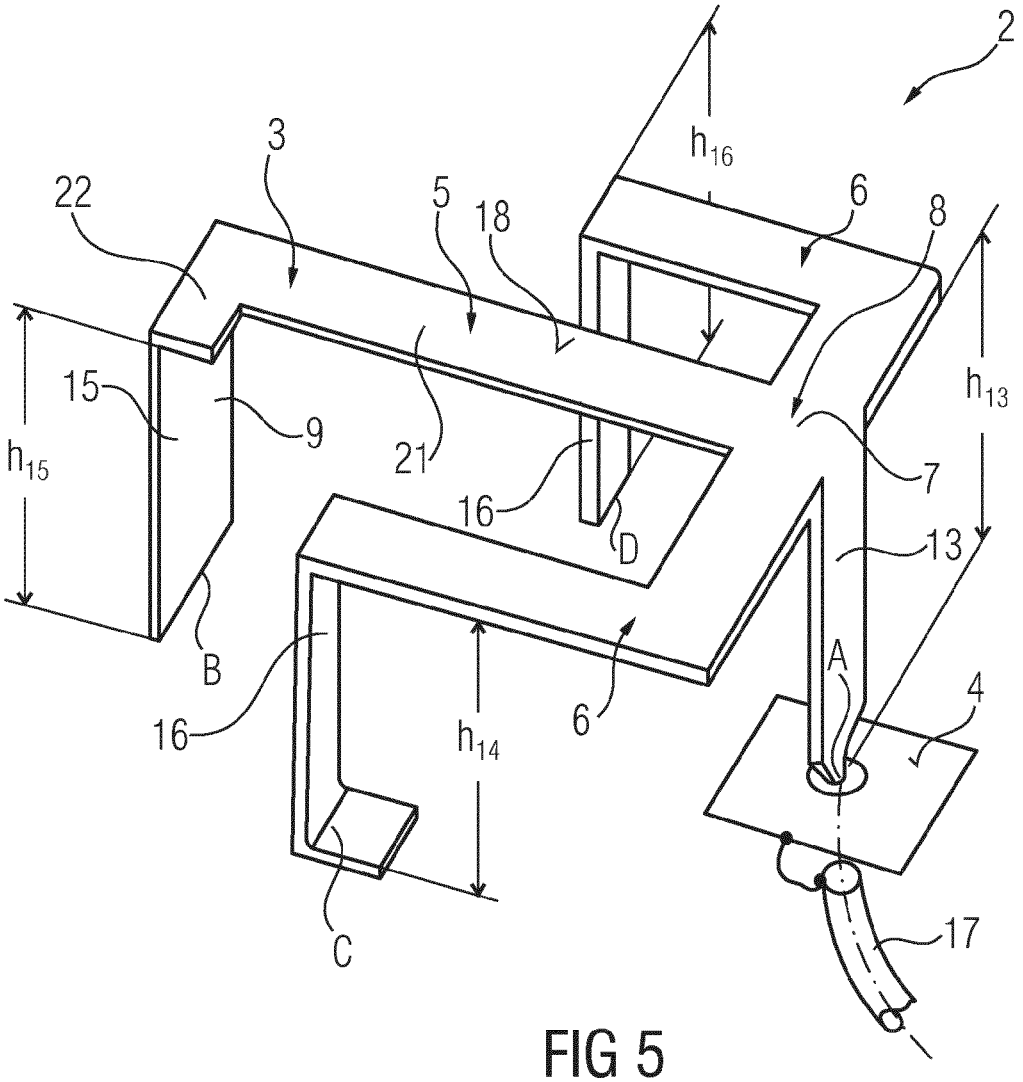
FIG. 5 shows a schematic perspective view of an antenna structure of an symmetric crossed dipole according to a further embodiment of the invention.

FIG. 5 shows a schematic perspective view of an antenna structure 2 of an asymmetric crossed dipole 8 according to a second embodiment of the invention. In this embodiment of the invention, the asymmetry of the crossed dipole is extreme, since the limb 13 of the U-shaped λ/2 dipole 5 is arranged directly next to the crossing point 7 and is connected to the feed line 17 via the base point A. In contrast to the preceding first embodiment of the antenna structure, this antenna structure is provided for use in the region of the windshield.

LIST OF REFERENCE SYMBOLS

1 Antenna structure ($1^{st}$ embodiment)
2 Antenna structure ($2^{nd}$ embodiment)
3 Circular-polarized antenna
4 Curved surface
5 First dipole
6 Second dipole
7 Crossing point
8 Crossed dipole
9 Sheet metal material
10 Vehicle roof
11 Top
12 Shielding chamber
13 Limb
14 Limb
15 Limb
16 Limb
17 Feed line
18 Crossing plane
19 Plastic cover
20 Vehicle
21 Section
22 Lug
23 Output jack
24 Dipole end
A Base point
B Base point
C Base point
D Base point
h Height

The invention claimed is:

1. An antenna structure of a circular-polarized antenna that can be arranged on an electrically conductive surface, the antenna structure comprising:

a first λ/2 dipole, a second λ/2 dipole, a crossing point for the first and second λ/2 dipoles to form a crossed dipole;

said λ/2 dipoles forming said crossed dipole being electrically conductively connected at said crossing point and, in relation to said crossing point, having a geometric asymmetry in at least one longitudinal direction of said λ/2 dipoles to form respective dipole limbs of different lengths from said crossing point, to thereby set a desired phase shift;

said antenna structure having only one feed point, positioned at one end of one of said λ/2 dipoles; and wherein each one of said λ/2 dipoles includes at least one extending parallel to a plane and at least one leg extending at an angle with respect to the plane.

2. The antenna structure according to claim 1, wherein said first λ/2 dipole is bent in a U shape and said second λ/2 dipole is bent in a U shape.

3. The antenna structure according to claim 2, wherein said crossing λ/2 dipoles bent in a U shape comprise a punched and bent sheet metal material.

4. The antenna structure according to claim 2, wherein a height and hence said limb length of said four limbs of said λ/2 dipoles bent in a U shape matches a curvature of the electrically conductive surface, to thereby obtain a horizontal crossing plane for the crossing λ/2 dipoles.

5. The antenna structure according to claim 1, wherein said crossing λ/2 dipoles are disposed on a printed circuit board material.

6. The antenna structure according to claim 1, wherein the electrically conductive surface is a vehicle roof.

7. The antenna structure according to claim 1, wherein the circular-polarized antenna has an SDARS antenna for satellite communication frequencies fSDARS in a range 2.320 GHz≤fSDARS≤2.345 GHz.

8. The antenna structure according to claim 7, wherein the SDARS antenna is disposed on an electrically conductive top of a shielding chamber of an antenna circuit board, and the shielding chamber encloses at least one of an antenna matching circuit, a tuner, or an amplifier.

9. The antenna structure according to claim 1, wherein the circular-polarized antenna has a GPS antenna for satellite navigation frequencies fGPS in a range 1.574 GHz≤fGPS≤1.577 GHz.

10. The antenna structure according to claim 9, wherein the GPS antenna is arranged on an electrically conductive top of a shielding chamber of an antenna circuit board, and the shielding chamber encloses at least one of an antenna matching circuit, a tuner, or an amplifier.

11. The antenna structure according to claim 1, wherein a limb of one of said λ/2 dipoles is connected to a matching network and a coaxial feed line or to a receiver or transceiver.

* * * * *